United States Patent [19]

Huang et al.

[11] Patent Number: 4,685,515

[45] Date of Patent: Aug. 11, 1987

[54] MODIFIED 7 SPOT PATTERNS OF HORIZONTAL AND VERTICAL WELLS FOR IMPROVING OIL RECOVERY EFFICIENCY

[75] Inventors: Wann-Sheng Huang; Margaret A. Hight, both of Houston, Tex.

[73] Assignee: Texaco Inc., White Plains, N.Y.

[21] Appl. No.: 835,703

[22] Filed: Mar. 3, 1986

[51] Int. Cl.[4] ..... E21B 43/24; E21B 43/30

[52] U.S. Cl. ..... 166/50; 166/245; 166/272

[58] Field of Search ..... 166/245, 268, 272, 50, 166/52

[56] References Cited

U.S. PATENT DOCUMENTS

| | | | |
|---|---|---|---|
| 2,914,309 | 11/1959 | Salomonsson | 166/59 X |
| 3,136,359 | 6/1964 | Graham | 166/272 X |
| 4,356,866 | 11/1982 | Savins | 166/50 X |
| 4,375,302 | 3/1983 | Kalmar | 166/272 X |
| 4,384,613 | 5/1983 | Owen et al. | 166/245 X |
| 4,390,067 | 6/1983 | Willman | 166/245 |
| 4,434,849 | 3/1984 | Allen | 166/50 X |
| 4,503,910 | 3/1985 | Shu | 166/263 |
| 4,535,845 | 8/1985 | Brown et al. | 166/272 |
| 4,598,770 | 7/1986 | Shu et al. | 166/245 |

*Primary Examiner*—George A. Suchfield

*Attorney, Agent, or Firm*—Jack H. Park; Kenneth R. Priem; Harold J. Delhommer

[57] ABSTRACT

The invention is a method of recovering hydrocarbons from an underground formation by employing modified 7 spot well patterns which contain six substantially vertical corner wells forming a substantially hexagonal well pattern and six substantially horizontal wells located within the hexagonal well pattern running between each of the vertical corner wells and the center of the well pattern. Preferably, the modified 7 spot pattern will also contain a substantially vertical central well located relatively near the center of the substantially hexagonal well pattern. Another embodiment contains six substantially vertical corner wells forming a substantially hexagonal well pattern, a substantially vertical central well and six sets of three horizontal wells, each set of three horizontal wells forming a substantially Y-shaped pattern.

23 Claims, 4 Drawing Figures

MODIFIED 7 SPOT PATTERNS OF HORIZONTAL AND VERTICAL WELLS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with modified 7 spot well patterns employing horizontal wells placed between vertical wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unsually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a method of recovering hydrocarbons from an underground formation by employing modified 7 spot well patterns. The patterns contain six substantially vertical corner wells forming a substantially hexagonal well pattern and six substantially horizontal wells located within the hexagonal well pattern running like the spokes of a wheel between each of the vertical corner wells and the center of the well pattern. Preferably, the modified 7 spot pattern will also contain a substantially vertical central well located relatively near the center of the substantially hexagonal well pattern.

An alternate embodiment contains a second set of six substantially horizontal wells. Each of the additional six horizontal wells is located between the corner wells, each horizontal well having one end located relatively near a vertical corner well and the other end located relatively near an adjacent vertical corner well.

A third embodiment contains a distinctly different combination of horizontal wells with the vertical wells of the 7 spot pattern. This pattern contains six substantially vertical corner wells forming a substantially hexagonal well pattern, a substantially vertical central well and six sets of three horizontal wells. Each set of three horizontal wells forms a substantially Y-shaped pattern wherein one of the three ends of the Y-shaped pattern is located relatively near the central well and the other two ends of the Y-shaped pattern are located relatively near the two adjacent corner wells.

DETAILED DESCRIPTION

Figure 1:
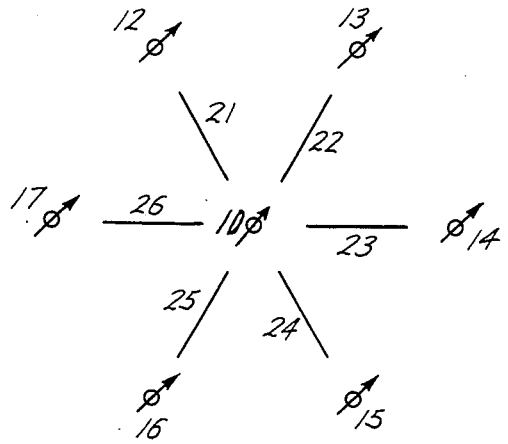
FIG. 1 illustrates the modified 7 spot pattern containing a vertical central injection well.

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all developed hydrocarbon reservoirs have vertical wells which have already been drilled in the reservoirs. Thus, ways must be found to coordinate the use of horizontal wells with existing vertical well patterns.

The invention method provides a way of achieving horizontal well advantages by using substantially horizontal wells in conjunction with common 7 spot vertical well patterns for improving oil recovery efficiency. The invention requires that six substantially vertical corner wells form a substantially hexagonal well pattern and that a first set of six substantially horizontal wells be drilled within the hexagonal well pattern. Each of the horizontal wells is drilled so that one end is located relatively near the center of the substantially hexagonal well pattern and the other end of each horizontal well is located relatively near one of the six vertical corner wells.

A second set of six substantially horizontal wells is added between the corner wells to form a second embodiment. In this modified 7 spot pattern, one end of each well in the second set of horizontal wells is located relatively near a vertical corner well and the other end of the same horizontal well is located relatively near an adjacent vertical corner well. It is preferred that a substantially vertical central well be located relatively near the center of the hexagonal well pattern in all of the modified 7 spot embodiments of the invention. In most cases, the vertical central well will be an injection well. The corner vertical wells may be injection or production wells.

Another embodiment entails a different arrangement of horizontal wells within the hexagonal well pattern of a 7 spot. This embodiment contains six substantially vertical corner wells forming the hexagonal well pattern around a substantially vertical central well located relatively near the center of the hexagonal pattern. Eighteen horizontal wells are drilled in sets of three horizontal wells, each within the confines of the hexagonal pattern. The wells are drilled from six different horizontal well pads located relatively near the center of each of the six triangles formed by the central well and two adjacent corner wells. Each set of three horizontal wells forms a Y-shaped pattern with the common ends of the three horizontal wells terminating at the horizontal well pad and the opposite ends of the three horizontal wells located relatively near the central well and the two adjacent corner wells.

Optionally, more than one substantially vertical well may be located at approximately the center of the substantially hexagonal well pattern. Since the vertical central well is most preferably a central injection well, it may be desirable to employ multiple central injection wells. Additional central injection wells may be especially desirable in tight formations where fluid injectivity is a problem.

In the embodiments which do not contain a central injection well, a blind spot of high oil saturation will normally be left in the center of the well pattern. One possible method of recovering the oil from this blind spot is to drill a vertical well and employ a push-pull thermal process.

Formation characteristics and existing vertical wells may require that the pattern be shaped very roughly like a hexagonal figure without 60° angles. Such patterns are intended to be encompassed within the phrase "substantially hexagonal pattern".

The substantially vertical central well and vertical corner wells may be either injection wells or production wells, but are preferably injection wells. The horizontal wells are preferably production wells, but may also be employed as injection wells under certain operational sequences. In thermal recovery operations, it is particularly preferred to inject a thermal fluid into wells prior to placing the wells on production in order to treat the formation in the immediate vicinity of the future production wells. Various flooding schemes may also be employed in which these wells may be alternately production and injection wells. The vertical and horizontal wells are preferably completed in the bottom third, most preferably, the bottom fifth of the hydrocarbon bearing formation.

The horizontal and vertical wells are all located, or at least perforated, so that a sufficient distance exists between the perforation intervals of each of the horizontal wells and the substantially vertical corner and central wells to prevent direct communication between the different wells. Preferably, the sufficient distance is at least 30 feet of undrilled formation. Large thief zones or fractures will preferably not run between the perforated intervals of nearby horizontal and vertical wells. Consequently, care must be taken to avoid locating perforations of producing horizontal wells too near the injection well or wells.

A significant advantage of the invention well pattern is that many of the horizontal wells may be drilled and completed from a common horizontal well pad. Thus, drilling costs are greatly reduced. For instance, the six horizontal wells of the FIGS. 1, 2 and 3 embodiments may all be drilled and completed from a single, centrally located horizontal well pad, located near the center of the pattern.

Figure 2:
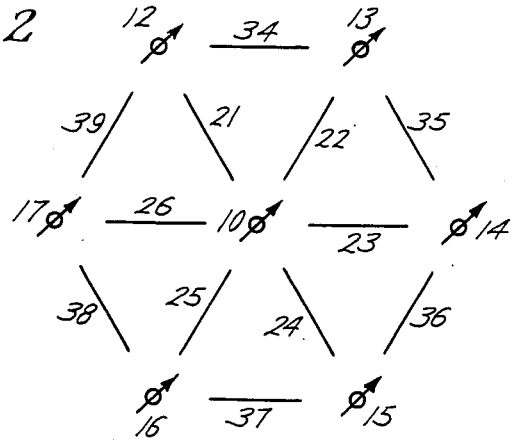
FIG. 2 illustrates the well pattern of FIG. 1 modified by the addition of six horizontal wells between the vertical corner wells.
Figure 3:
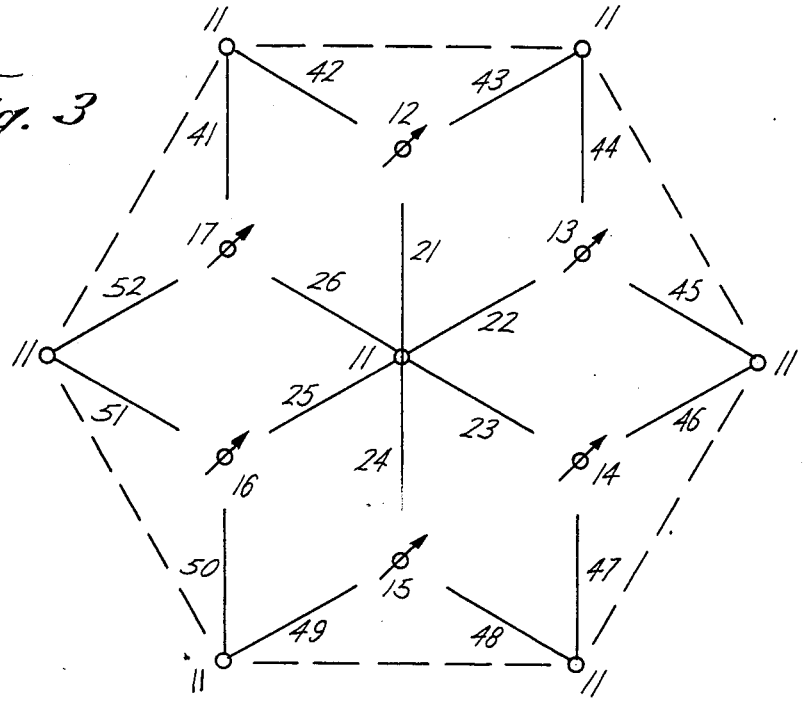
FIG. 3 illustrates the FIG. 1 embodiment without a vertical central well. Portions of neighboring patterns are shown in FIG. 3 to demonstrate how the pattern is duplicated over additional acreage.

FIGS. 1, 2, 3 and 4 diagram the modified 7 spot drilling and production patterns. FIGS. 1, 2 and 3 show different but similar modified 7 spot patterns wherein six substantially horizontal wells 21, 22, 23, 24, 25 and 26 run between the center of the pattern and the six substantially vertical corner injection wells 12, 13, 14, 15, 16 and 17. In FIGS. 1 and 2 the central injection well 10 is located at the center of the pattern. FIG. 2 also contains a second set of six horizontal wells 34, 35, 36, 37, 38 and 39 all located between the six corner wells 12, 13, 14, 15, 16 and 17.

FIG. 3 illustrates a different embodiment without a central injection well. Horizontal well pads 11 are located at seven different spots in FIG. 3. The horizontal wells 21, 22, 23, 24, 25 and 26 were all drilled from horizontal well pad 11 at the center of the pattern. The other horizontal well pads 11 illustrate how the modified 7 spot pattern of FIG. 3 is duplicated over additional acreage. Additional horizontal wells 41, 42, 43, 44, 45, 46, 47, 48, 49, 50, 51 and 52 all radiate from the horizontal well pads 11 of adjacent modified 7 spot patterns.

Figure 4:
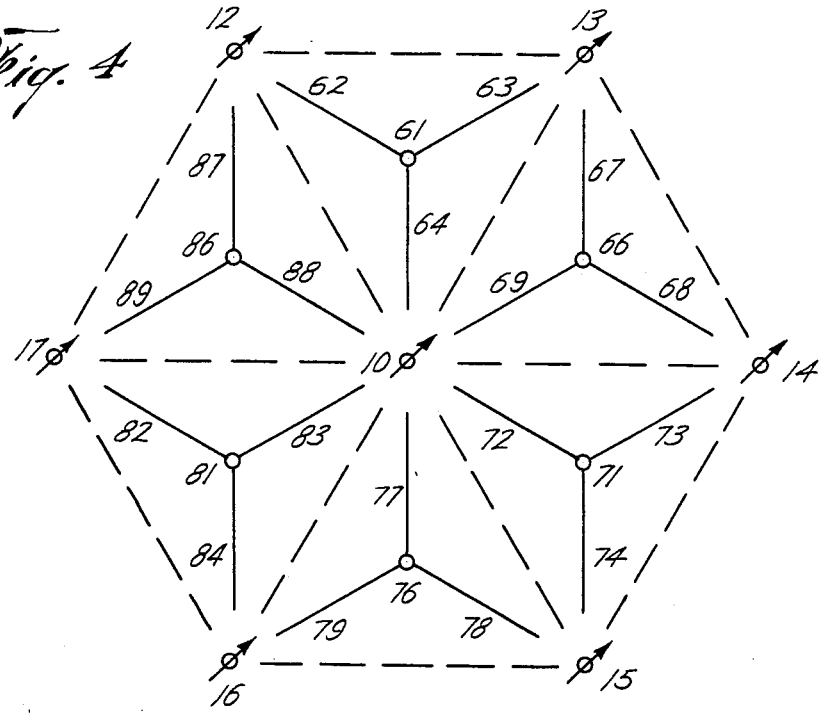
FIG. 4 illustrates a 7 spot pattern containing six sets of three horizontal wells each.

Another embodiment is illustrated in FIG. 4 which contains the same six corner injection wells 12, 13, 14, 15, 16 and 17 arranged in a hexagonal well pattern around central injection well 10. The FIG. 4 embodiment also contains 18 horizontal wells grouped into six sets of three horizontal wells each. Spots 61, 66, 71, 76, 81 and 86 are the six horizontal well pads for each of the sets of horizontal wells. From these pads the 18 horizontal wells 62, 63, 64, 67, 68, 69, 72, 73, 74, 77, 78, 79, 82, 83, 84, 87, 88 and 89 are all drilled.

Simulation results indicate that the use of horizontal wells in conjunction with vertical wells according to the invention are highly effective in recovering oil, particularly oil from blind spot areas in mature steam floods. Horizontal and vertical well combinations used in the development stage of a reservoir will also minimize blind spot formation. The horizontal wells speed oil recovery and thus, shorten project lives. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells in their perforation intervals are not critical, except that such factors will affect the well spacing and the economics of the process. Perforation size and density will be a function of factors such as flow rate, temperatures and pressures employed in a given operation. Such decisions should be determined by conventional drilling criteria, the characteristics of the specific formation, the economics of a given situation, and the well known art of drilling horizontal wells.

Many variations of the method of this invention will be apparent to those skilled in the art from the foregoing discussion and examples. Variations can be made without departing from the scope and spirit of the following claims.

What is claimed is:

1. A modified 7 spot well pattern for recovering hydrocarbons from an underground formation, which comprises:

six substantially vertical corner wells forming a substantially hexagonal well pattern; and a first set of six substantially horizontal wells, each horizontal well having one end located relatively near the center of the substantially hexagonal well pattern and the other end located relatively near one of the six vertical wells.

2. The well pattern of claim 1, further comprising a second set of six substantially horizontal wells, each horizontal well of the second set having one end located relatively near a vertical corner well and the other end located relatively near an adjacent vertical corner well.

3. The well pattern of claim 2, further comprising a substantially vertical central well located relatively near the center of the substantially hexagonal well pattern.

4. The well pattern of claim 3, wherein the central well is an injection well.

5. The well pattern of claim 2, wherein the first set of horizontal wells are injection wells and the second set of horizontal wells are production wells.

6. The well pattern of claim 2, wherein the corner wells are injection wells.

7. The well pattern of claim 2, wherein the corner wells are production wells.

8. The well pattern of claim 1, further comprising a substantially vertical central well located relatively near the center of the substantially hexagonal well pattern.

9. The well pattern of claim 8, wherein the central well is an injection well.

10. The well pattern of claim 8, wherein the central well is a production well.

11. The well pattern of claim 8, wherein the horizontal wells are production wells.

12. The well pattern of claim 8, wherein the horizontal wells are injection wells.

13. The well pattern of claim 8, wherein the corner wells are injection wells.

14. The well pattern of claim 8, wherein the corner wells are production wells.

15. The well pattern of claim 8, wherein the horizontal wells are completed in the bottom fifth of the formation.

16. The well pattern of claim 8, wherein the horizontal wells are drilled form a single well pad located relatively near the center of the substantially hexagonal well pattern.

17. The well pattern of claim 8, further comprising at least one more substantially vertical well located relatively near the center of the substantially hexagonal well pattern.

18. A modified 7 spot well pattern for recovering hydrocarbons from an underground formation, which comprises:

six substantially vertical corner injection wells forming a substantially hexagonal well pattern;

a substantially vertical central injection well located relatively near the approximate center of the substantially hexagonal well pattern; and six substantially horizontal production wells, each horizontal well having one end located relatively near the vertical central well and the other end located relatively near one of the six vertical corner wells.

19. A modified 7 spot well pattern for recovering hydrocarbons from an underground formation, which comprises:

six substantially vertical corner wells forming a substantially hexagonal well pattern;

a substantially vertical central well located relatively near the center of the substantially hexagonal well patterns; and six sets of three substantially horizontal wells, each set of three horizontal wells forming a substantially Y-shaped pattern with one of the three ends of each Y-shaped pattern located relatively near the central well and the other two ends of each Y-shaped pattern located relatively near the two adjacent corner wells.

20. The well pattern of claim 19, wherein the vertical central well is an injection well.

21. The well pattern of claim 19, wherein the vertical corner wells are injection wells.

22. The well pattern of claim 19, wherein the horizontal wells are production wells.

23. A modified 7 spot well pattern for recovering hydrocarbons from an underground formation, which comprises:

six substantially vertical corner injection wells forming a substantially hexagonal well pattern;

a first set of six substantially horizontal production wells, each horizontal well having one end located relatively near the center of the substantially hexagonal well pattern and the other end located relatively near one of the six vertical corner injection wells;

a substantially vertical central injection well located relatively near the center of the substantially hexagonal well pattern; and a second set of six substantially horizontal production wells, each horizontal well of the second set having one end located relatively near a vertical corner injection well and the other end located relatively near an adjacent vertical corner injection well.

* * * * *